US009022494B2

(12) United States Patent
Lehman et al.

(10) Patent No.: US 9,022,494 B2
(45) Date of Patent: May 5, 2015

(54) REFRIGERATOR WITH STEPPED LINER TO HIDE SEAM BETWEEN LINER AND FALSE WALL

(75) Inventors: Derek Thomas Lehman, Coralville, IA (US); Frank Weston Maglinger, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 87 days.

(21) Appl. No.: 13/616,772

(22) Filed: Sep. 14, 2012

(65) Prior Publication Data

US 2014/0077680 A1 Mar. 20, 2014

(51) Int. Cl.
*A47B 96/04* (2006.01)
*F25D 23/06* (2006.01)

(52) U.S. Cl.
CPC ..... *F25D 23/06* (2013.01); *Y10T 29/49359* (2015.01)

(58) Field of Classification Search
CPC ..... F25D 23/06; F25D 23/08; F25D 23/066
USPC ..... 312/406, 401, 406.1–407.1
See application file for complete search history.

(56) References Cited

U.S. PATENT DOCUMENTS

| | | | | |
|---|---|---|---|---|
| 3,401,997 | A * | 9/1968 | Hanifan | 312/406.1 |
| 3,868,829 | A * | 3/1975 | Mann et al. | 62/285 |
| 5,558,419 | A | 9/1996 | Dasher et al. | |
| 5,727,859 | A | 3/1998 | Jeong et al. | |
| 6,085,542 | A | 7/2000 | Johnson et al. | |
| 6,112,542 | A * | 9/2000 | Lee | 62/407 |
| 6,209,342 | B1 | 4/2001 | Banicevic et al. | |
| 6,880,949 | B2 | 4/2005 | Miozza et al. | |
| 7,343,757 | B2 | 3/2008 | Egan et al. | |
| 7,573,701 | B2 | 8/2009 | Doberstein et al. | |
| 8,020,403 | B2 | 9/2011 | Rotter et al. | |

FOREIGN PATENT DOCUMENTS

DE 10 2010 031 249 * 1/2012

* cited by examiner

*Primary Examiner* — Daniel J Troy
*Assistant Examiner* — Timothy M Ayres

(57) ABSTRACT

A bottom mount refrigerator is provided with refrigerator components housed in a space adjacent the top of the fresh food compartment between a false ceiling and the top wall of the compartment. The top wall includes a stepped portion formed in the liner forming the compartment. The stepped portion is positioned near the top and front of the compartment, and it includes a section that is lower than the remainder of the top wall. The stepped portion includes a rear facing face in the interior of the compartment, and the false ceiling is positioned between the rear facing face and the back wall. The ceiling extends horizontal from the rear wall before angling upward to abut the face of the stepped portion. The false ceiling may also contain apertures to provide access to the components housed between the ceiling and the top wall.

20 Claims, 7 Drawing Sheets

REFRIGERATOR WITH STEPPED LINER TO HIDE SEAM BETWEEN LINER AND FALSE WALL

FIELD OF THE INVENTION

The present invention relates generally to refrigerators. More particularly, but not exclusively, the invention relates to bottom mount refrigerators having an upper fresh food compartment, with a false wall attached to the liner.

BACKGROUND OF THE INVENTION

Bottom mount refrigerators include a freezer compartment on the bottom, with the fresh food or refrigerated compartment above the freezer compartment. In order to preserve the amount of room in the fresh food compartment, an ice maker and other components are mounted at the top of the compartment. The ice maker is then connected in operation with a dispenser on one of the fresh food doors. The door may also include an ice container for storing ice and keeping the stored ice at or under the temperature of freezing.

In order to enclose the ice maker and other components, an upper housing is added at the top of the fresh food compartment. The housing includes apertures for the components, which may include the ice maker, light(s), filter, temperature controls, and the like. The housing may also be known as a false ceiling, as it gives the impression that it is the top of the liner forming the fresh food compartment. However, in reality, the housing protects the components and hides the wiring and other undesirable aspects of the components from the consumer, while still providing access to the components for a repair person, if needed.

However, the line of interface between the housing or false ceiling and the liner defining the fresh food compartment can be unattractive to consumers. Existing solutions involve adding a lip extending downward from the top wall of the liner to try to conceal the line of interface. While the lip may aid in concealing the appearance of gaps between components, the line of interface is still present, and may include a gap between the edge of the housing and the liner.

Therefore, there is a need in the art for a method of hiding the line of interface between the upper housing or false ceiling and the top wall of the liner defining the compartment. There is also a need in the art for a method of accounting for any variation in fit between the liner and the components housed behind the upper housing, including any gap that may exist due to the variation.

SUMMARY OF THE INVENTION

Therefore, it is principal object, feature, and/or advantage of the present invention to provide an apparatus that overcomes the deficiencies in the art.

It is another object, feature, and/or advantage of the present invention to provide a liner having a stepped portion to hide the line of interface between the top wall of the liner and an upper housing.

It is yet another object, feature, and/or advantage of the present invention to provide a liner having a stepped portion to account for any variation in fit between components and the liner.

It is still a further object, feature, and/or advantage of the present invention to provide a liner having a stepped portion near the top and front of the liner to hide any gaps in the construction of a refrigerator.

It is still another object, feature, and/or advantage of the present invention to provide a refrigerator having a false ceiling connected to a liner to house various refrigerator components.

It is another object, feature, and/or advantage of the present invention to provide an improved method of manufacturing a refrigerator that includes forming a liner to include a stepped portion therein.

These and/or other objects, features, and advantages of the present invention will be apparent to those skilled in the art. The present invention is not to be limited to or by these objects, features and advantages. No single embodiment need provide each and every object, feature, or advantage.

According to one aspect of the present invention, a refrigerator is provided. The refrigerator includes a cabinet and a liner positioned in the cabinet. The liner forms a compartment including a top wall, opposing side walls, a back wall, and a bottom wall. The top wall includes a stepped portion opposite from the back wall. A false ceiling is spaced apart from the top wall and extends between the back wall and the stepped portion of the top wall.

According to another aspect of the present invention, a method of manufacturing a refrigerator is provided. The method includes forming a cabinet. A compartment is formed from a liner, and includes a top wall, opposing side walls, a back wall, and a bottom wall. The top wall includes a stepped portion opposite from the back wall. The compartment is positioned within the cabinet, and a false ceiling is positioned in the compartment at the top wall and between the back wall and the stepped portion.

According to another aspect of the present invention, a refrigerator is provided. The refrigerator includes a cabinet and a liner positioned in the cabinet. The liner defines a compartment comprising a top wall, opposing side walls, a back wall, a bottom wall, and a front edge. The top wall also includes a stepped portion near the front edge of the compartment, wherein the stepped portion comprises a generally vertical portion. A false ceiling is spaced apart from the top wall, extends from the back wall towards the front edge, and then angles upwardly towards the generally vertical portion of the stepped portion.

DETAILED DESCRIPTION OF THE PREFERRED EMBODIMENTS

Figure 1:
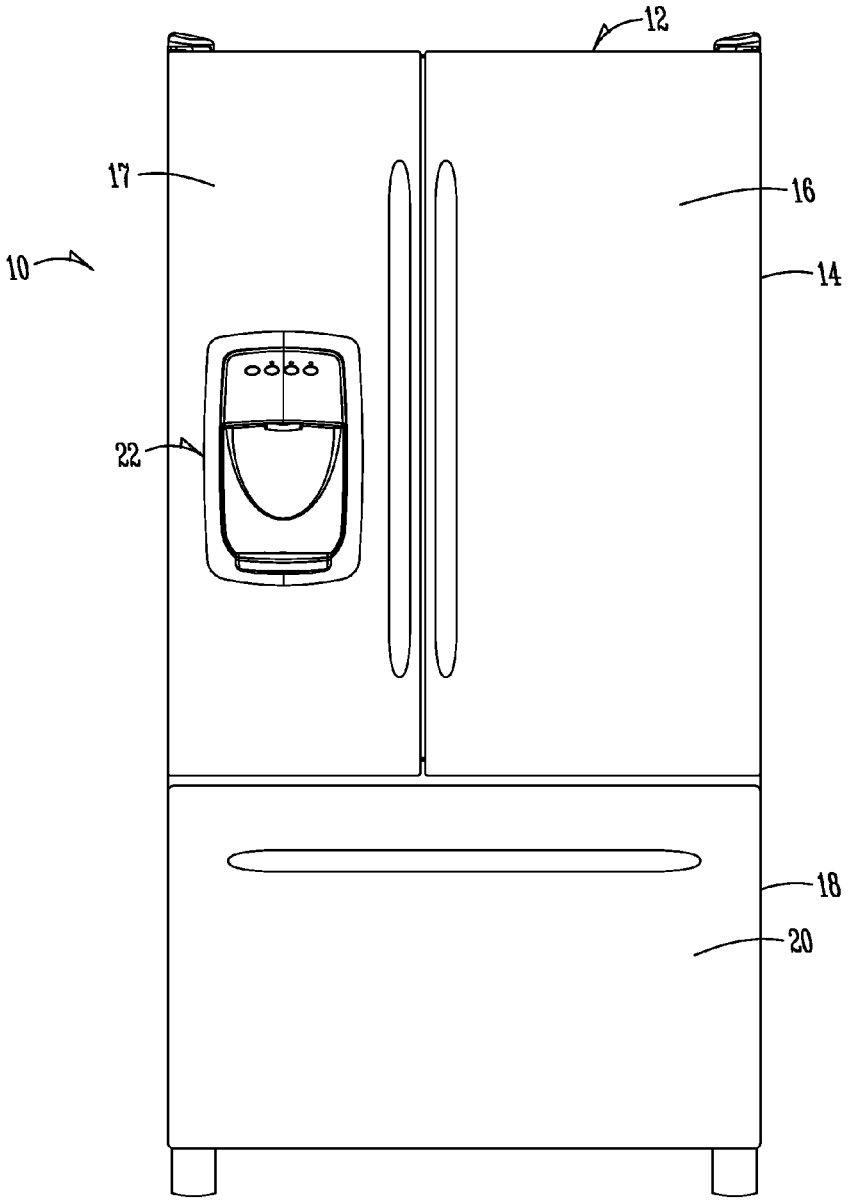
FIG. 1 is a front elevation view of a bottom mount refrigerator.
Figure 2:
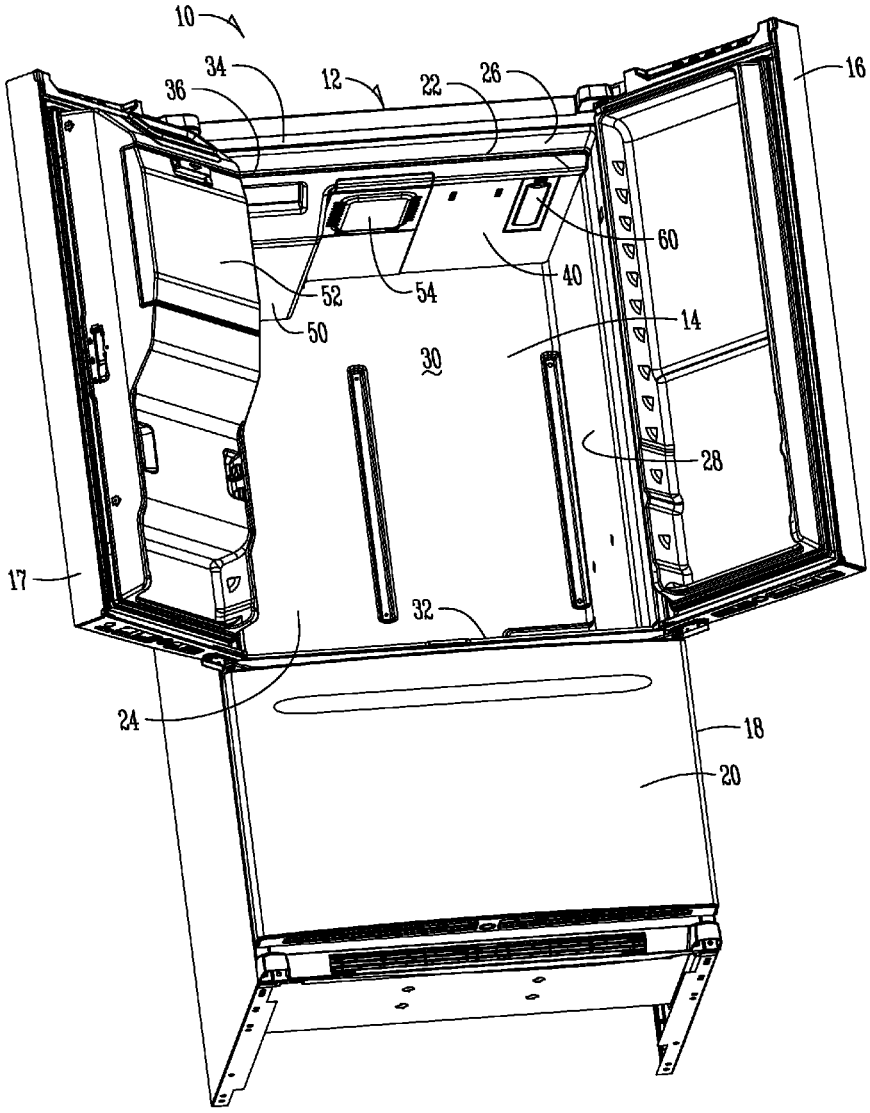
FIG. 2 is a perspective view of the bottom mount refrigerator of FIG. 1 having the fresh food compartment doors opened.

FIGS. 1 and 2 show an embodiment of a bottom mount refrigerator 10. The bottom mount refrigerator 10 includes a cabinet 12 encapsulating the refrigerator compartments. The upper compartment is a fresh food compartment 14. First and second French doors 16, 17 provide access to the interior of the fresh food compartment 14. As shown in FIG. 1, a dispenser 22 is positioned on one of the doors 16, 17 of the fresh food compartment 14. The dispenser 22 may be a water dispenser, ice dispenser, other beverage dispenser, or some combination thereof. Furthermore, the dispenser may be placed on either door, or the present invention does not require a dispenser on the exterior door of any of the compartments. Positioned generally below the fresh food compartment 14 is a freezer compartment 18. A freezer door 20 provides access to the freezer compartment 18. In FIGS. 1 and 2, the freezer door 20 is a drawer-type door. However, the present invention contemplates that the freezer door 20 may be a drawer or a hinged door.

FIG. 2 shows the interior of the fresh food compartment 14 of the refrigerator 10. The fresh food compartment 14 comprises a liner 24 positioned in the upper area of the cabinet 12. The liner 24 includes a top wall 26, opposing side walls 28, 29, a back wall 30, and a bottom wall 32. Furthermore, there is a front edge 34 along the edge of the top, side and bottom walls. Also shown in FIG. 2 is an upper housing cover or false ceiling 40. The false ceiling 40 extends from the back wall 30 towards the front edge 34, and is spaced from the top wall 26 of the liner 24. The false ceiling 40 creates a space between the top wall and the false ceiling to house various components of the refrigerator 10. For instance, FIG. 2 shows an ice maker 50 portion, a light cover 54, and a filter cover 60 positioned between the false ceiling 40 and the top wall 26. While these specific components are shown in the figure, it should be appreciated that not all components are required, and additional components may be included as well. FIG. 2 also shows an ice compartment 52 on the interior of the door 17 and adjacent the dispenser 22. Thus, the ice maker (not shown) creates ice, which is transported to an ice container (not shown) within the ice compartment 52 for holding at or below freezing until a consumer wishes to obtain ice from the dispenser 22 (see FIG. 1). The location of the ice maker and other components near the top wall 26 of the fresh food compartment 14 allows the greatest amount of space within the fresh food compartment.

Figure 3:
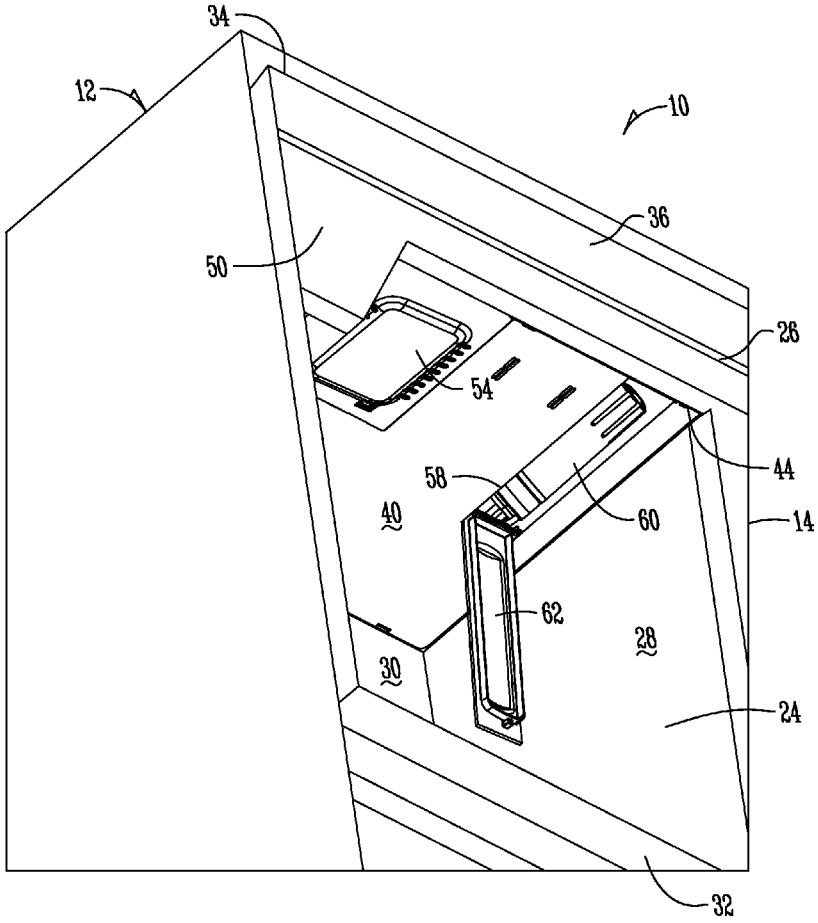
FIG. 3 is an enlarged view of the upper portion of the fresh food compartment of the refrigerator.

FIG. 3 is an enlarged sectional view of the upper portion of the fresh food compartment 14 of the refrigerator 10. The liner 24 defining the fresh food compartment 14 includes a stepped portion 36, as will be discussed below. The false ceiling or upper housing 40 is positioned at the upper portion of the fresh food compartment 14 and extends generally between the back wall 30 and a vertical face 38 (see FIG. 6) of the stepped portion 36. Thus, the front edge of the false ceiling 40 will be hidden behind the vertical face 38 of the stepped portion 36, such that a user will not see the seam between the false ceiling 40 and the liner 24, thus hiding any potential gaps or variations in size of the false ceiling 40.

Furthermore, FIG. 3 shows examples of components positioned between the false ceiling 40 and the top wall 26 of the liner 24. As discussed above, potential components include a filter 60 and light 54. The false ceiling 40 includes an aperture 58 through the false ceiling to allow access to the filter 60. The aperture 58 is closed by a filter cover 62, which may be snap fit to the false ceiling 40 to provide access to change the filter 60. Likewise, the light cover 54 will be provided in a light aperture through the false ceiling. Therefore, the light will only be accessible to a consumer upon removing the cover 54. The false ceiling 40 attaches to the compartment via snaps. For example, also contained within the space between the false ceiling 40 and the top wall 26 may be an ice box assembly or ice maker (not shown) and a water tank bracket assembly (not shown). The false ceiling 40 may attach via snaps to the ice box assembly and water tank bracket assembly to hold the false ceiling in place. However, while the consumer will perceive a false ceiling to be the actual ceiling of the refrigerator 10, it is appreciated that the false ceiling may be removable by a repair person or like individual to provide access to the components hidden by the false ceiling 40.

Figure 4:
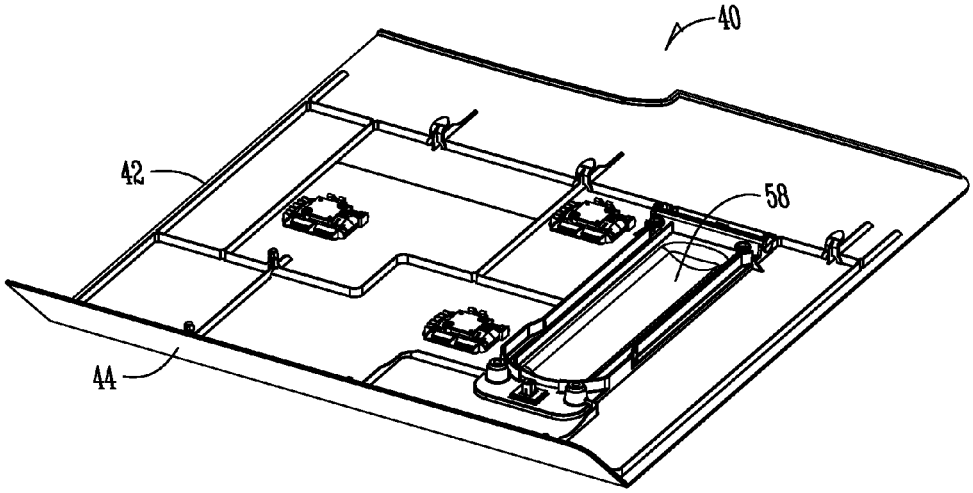
FIG. 4 is a perspective view of the false ceiling or upper housing of the refrigerator according to the present invention.

FIG. 4 is a perspective view of an example of a false ceiling or upper housing 40 of the refrigerator 10 according to an embodiment of the present invention. The false ceiling 40 of FIG. 4 includes a lower section 42 and a generally angled section 44. Furthermore, as shown in FIG. 4, the false ceiling or upper housing 40 will include a plurality of apertures, such as filter aperture 58 therethrough to provide access to components of the refrigerator, such as a filter 60. It should be appreciated that other apertures may be formed through the false ceiling or upper housing 40 as well, depending on the model of refrigerator.

Figure 5:
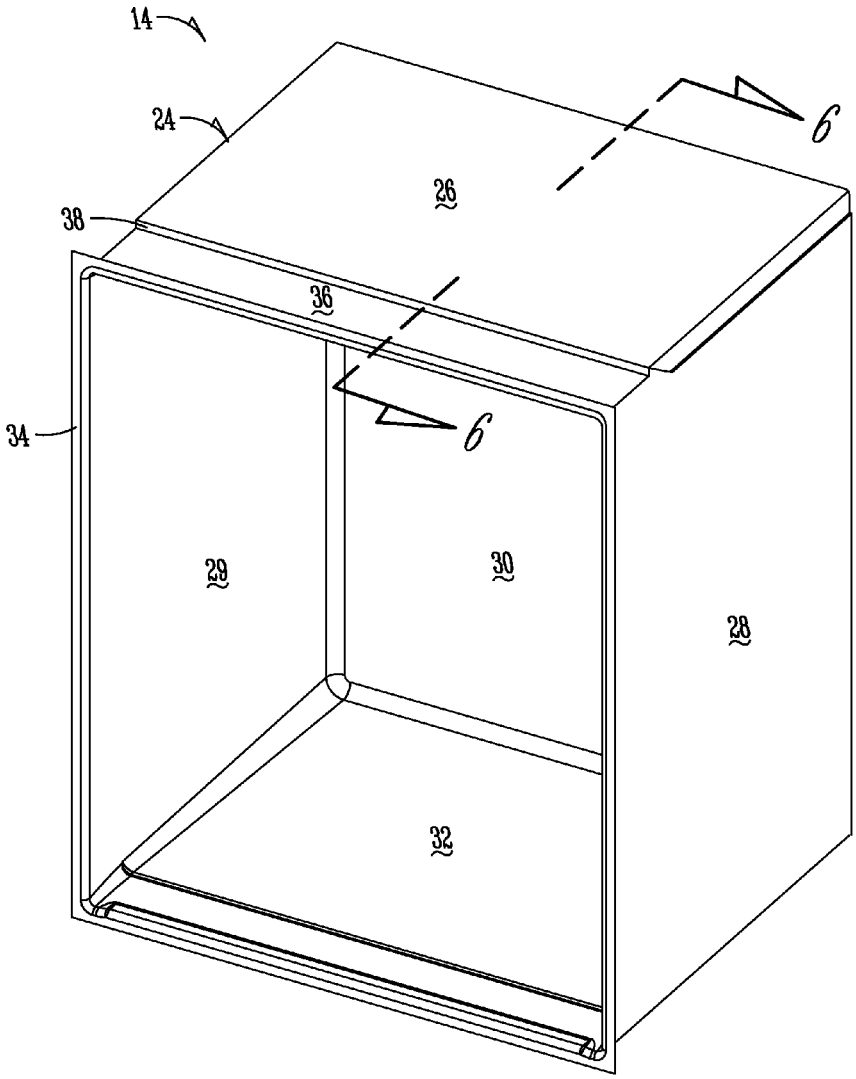
FIG. 5 is a perspective view of the liner defining the fresh food compartment of the refrigerator.

FIG. 5 is a perspective view of a liner 24 defining the fresh food compartment 14 of the refrigerator 10 according to the present invention. The liner 24 is formed by vacuforming a material about a mold. Thus, the mold may define the interior of the fresh food compartment 14 with the liner being vacuformed around said mold to create the fresh food compartment 14. As discussed above, the liner 24 includes a top wall 26, opposing side walls 28, 29, back or rear wall 30, and bottom wall 32. Furthermore, a lip or front edge 34 may be formed about the edges of the top, side, and bottom walls. Furthermore, the present invention includes a stepped portion 36 positioned in the top wall 26 and towards the front of the liner near the front edge 34. The stepped portion 36 is a generally recessed section of the top wall, creating a recess or valley between a vertical face 38 and the front edge 34. The width of the stepped portion may vary according to the model of refrigerator to which the liner 24 will be positioned to form a fresh food or freezer compartment.

The stepped portion 36 of the top wall 26 is formed at the same time the rest of the liner is vacuformed. A retractable mold is positioned over an end of the material that is to be the top wall 26 of the liner 24. The mold creates the recessed step portion 36 and is retractable to allow the formed liner to be removed from the vacuformed mold.

Figure 6:
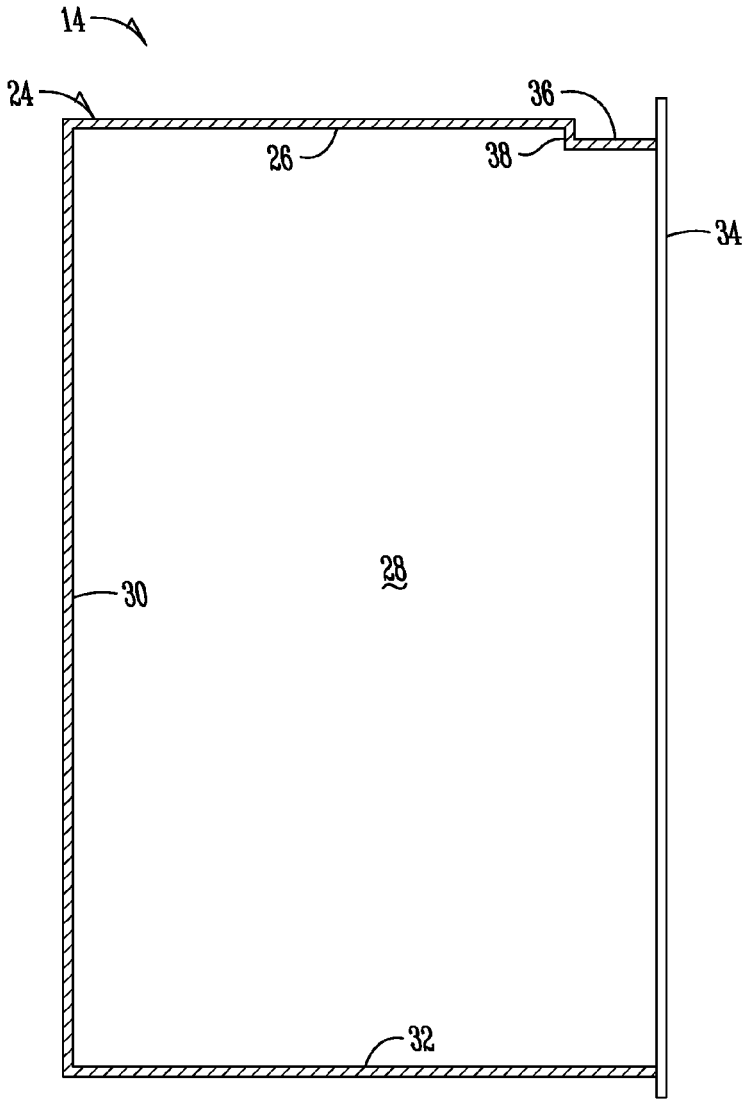
FIG. 6 is a sectional view of the liner of FIG. 5, showing the stepped portion of the liner.

FIG. 6 is a sectional view of the liner of FIG. 5 according to the arrows 6-6. FIG. 6 shows the top wall 26, back wall 30, side wall 28, bottom wall 32, and front edge in more detail. Furthermore, the stepped portion 36 is shown in greater detail as well. As shown, the stepped portion 36 is a recessed section creating a valley between the front edge 34 and a generally vertical face 38 across the entire width of the top wall 26 of the liner 24. While the face 38 is shown vertical, it is contemplated by the present invention that any angle relative to the generally horizontal top wall 26 is contemplated. Furthermore, the width of the stepped or recessed portion 36 may be varied according to any desired depth.

Figure 7:
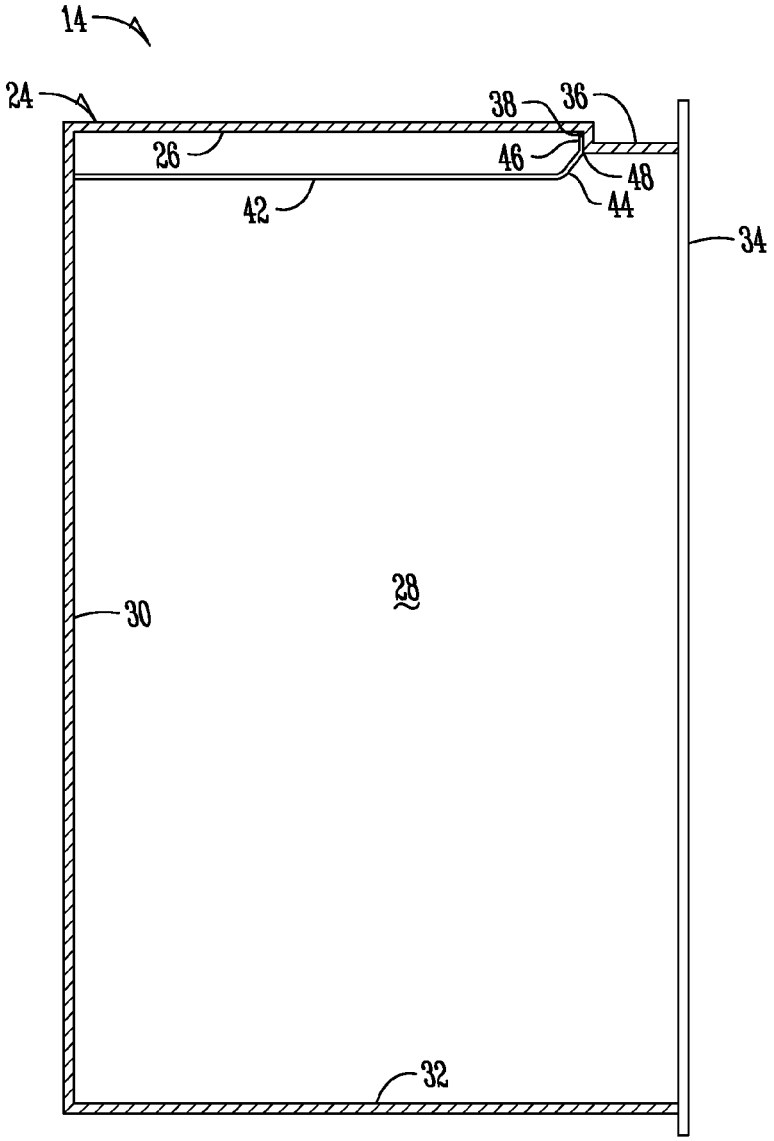
FIG. 7 is an enlarged sectional view showing the false ceiling or upper housing in place at the stepped portion of the liner of the refrigerator.

FIG. 7 is an enlarged sectional view showing the false ceiling or upper housing 40 in place at the stepped portion 36 of the liner 24 of the refrigerator 10. The depiction shown in FIG. 7 is exaggerated for purposes of this present invention. As shown in FIG. 7, the false ceiling or upper housing 40 extends generally horizontally from the back wall 30 towards the front edge 34. At a predetermined distance, the false ceiling 40 begins to angle both in a forward and upward manner. The angled section 44 extends from the lower or generally horizontal section 42 and terminates at the face 38 of the stepped portion 36. Therefore, the leading or upper edge of the angled section 44 will be positioned behind the face 38 when the false ceiling 40 is in place in the refrigerator 10. Thus, the leading edge of the angled portion 44 will not be viewable by a consumer when one of the doors 16, 17 are opened to access the interior of the fresh food compartment 14. Thus, the present invention aids in presenting a more aesthetic line of interface 48 between the false ceiling 40 and the liner 24. As has been mentioned, the size of the false ceiling and thus the space between the false ceiling and the liner may vary according to the number and type of components housed within the space. For instance, when an ice maker or ice making assembly is positioned, the housing may need to be longer with an angled section being longer to account for the amount of space by the ice making assembly.

The present invention also includes the instance wherein the false ceiling 40 acts as a false sidewall or floor. The false wall could be positioned on one of the sidewalls 28, 29 of the liner 24 to hide components or wiring along the wall. Furthermore, the false ceiling 40 could be used in conjunction with the bottom wall 32 of the liner to house components between the false floor and the bottom wall 32. One of the sidewalls 28, 29 or the bottom wall would include the stepped portion 36, similar to that in the top wall 26 as shown in the figures, such that the leading edge of a false wall or floor could be hidden behind the stepped portion for aesthetic purposes.

As mentioned, the present invention provides that the line of interface between the vacuformed liner and the injection molded upper housing or false ceiling is hidden by the step formed into the liner. The step also accounts for any variation and fit between the liner and the components housed within the space between the liner and the upper housing or false ceiling and hides any gap that may exist due to such variation. For instance, as the liner is foamed between the liner and the cabinet to provide insulation to the refrigerator, the shape and size of the interior of the liner may become distorted. Therefore, if the false ceiling or upper housing cover does not provide a perfect fit, a consumer may not know this, as the leading edge of the false ceiling is hidden behind the stepped portion or the face of the stepped portion. Thus, the present invention provides a more aesthetic view of the interior of the fresh food compartment.

The foregoing description has been presented for purposes of illustration and description, and is not intended to be exhaustive or to limit the invention to the precise form disclosed. It is contemplated that other alternative processes obvious to those skilled in the art are considered to be included in this invention. This description is merely an example of an embodiment. For example, the size and shape of the liner and various components may be varied. In addition, the components found in the refrigerator may also be varied according to the make and model of said refrigerator. The size and angle of the stepped portion, including the face, may also be varied according to specification. It is understood that many modifications, substitutions, and additions may be made which are within the intended spirit and scope of the invention. From the foregoing, it can be seen that the present invention accomplishes at least all of its stated objectives.

What is claimed is:

1. A refrigerator, comprising:

a cabinet;

a liner positioned in the cabinet, the liner forming a compartment including a top wall, opposing side walls, a back wall, and a bottom wall, wherein one of the walls of the liner includes a stepped portion opposite from the back wall;

the stepped portion comprising a portion of the liner wall that is recessed inward from the rest of the wall and substantially perpendicular thereto; and a false wall spaced apart from one of the liner walls and extending between the back wall and the stepped portion of one of the liner walls;

wherein a portion of the false wall is in contact with at least a portion of an inwardly recessed segment of the stepped portion such that a seam between the false wall and the wall is hidden from view by the stepped portion;

said portion of the false wall and substantially perpendicular portion of the stepped portion being substanially co-planar until a location at which the false wall extends acutely from the stepped portion, and the stepped portion extending substantially horizontally toward the front of the cabinet.

2. The refrigerator of claim 1 wherein the one of the liner walls is the top wall, and the false wall is a false ceiling.

3. The refrigerator of claim 2 wherein the stepped portion of the top wall is formed with the liner.

4. The refrigerator of claim 2 wherein the compartment is a fresh food compartment.

5. The refrigerator of claim 2 further comprising an ice maker disposed between the false ceiling and the top wall of the compartment.

6. The refrigerator of claim 2 wherein the stepped portion has a width generally the same as the width of the false ceiling.

7. The refrigerator of claim 2 further comprising a water filter positioned between the false ceiling and the top wall of the compartment.

8. The refrigerator of claim 2 further comprising a light positioned between the false ceiling and the top wall of the compartment.

9. The refrigerator of claim 8 further comprising a light cover over the light.

10. The refrigerator of claim 2 wherein the false ceiling is snap fit to components to fit between the stepped portion and the back wall of the compartment.

11. The refrigerator of claim 2 wherein the false ceiling comprises a bottom section and an angled section extending from the bottom section.

12. The refrigerator of claim 10 wherein the false ceiling further comprises a plurality of apertures.

13. A method of manufacturing a refrigerator, comprising:

forming a cabinet;

forming a compartment from a liner, the compartment comprising a top wall, opposing side walls, a back wall, and a bottom wall, wherein the top wall includes a stepped portion opposite from the back wall;

wherein the stepped portion comprising a portion of the top wall that is recessed inward and substantially perpendicular from the rest of the wall;

positioning the compartment within the cabinet; and positioning a false ceiling in the compartment at the top wall and between the back wall and the stepped portion such that a seam between the false ceiling and the top wall is hidden from view by the stepped portion;

wherein a portion of the false ceiling and the substantially perpendicular portion of the stepped portion being substantially co-planar until a location at which the false ceiling extends acutely from the stepped portion, and the stepped portion extending substantially horizontally toward the front of the cabinet.

14. The method of claim 13 further comprising forming a false ceiling comprising a bottom section and an angled section extending from the bottom section prior to positioning the false ceiling in the compartment.

15. The method of claim 14 further comprising forming a plurality of apertures in the false ceiling prior to positioning the false ceiling in the compartment.

16. The method of claim 15 further comprising installing an ice maker, water line, filter, and/or light between the false ceiling and the top wall of the compartment.

17. A refrigerator, comprising:

a cabinet;

a liner positioned within the cabinet, the liner defining a compartment comprising a top wall, opposing side walls, a back wall, a bottom wall, and a front edge, the top wall including a stepped portion near the front edge of the compartment, wherein the stepped portion comprises a generally vertical portion;

said stepped portion comprising a portion of the top wall that is recessed inward from the rest of the wall; and a false ceiling spaced apart from the top wall and extending from the back wall towards the front edge and then angled upwardly towards the generally vertical portion of the stepped portion and including a substantially vertical portion co-planar with and in contact with the vertical portion of the stepped portion;

wherein a seam between the false ceiling and the top wall is hidden from view by the stepped portion.

18. The refrigerator of claim 17 further comprising a plurality of components positioned between the false ceiling and the top wall.

19. The refrigerator of claim 17 wherein the generally vertical portion of the stepped portion includes an interior face towards the back wall.

20. The refrigerator of claim 17 wherein the stepped portion extends the width of the false ceiling.

* * * * *